US010605458B2

(12) United States Patent
Hack et al.

(10) Patent No.: US 10,605,458 B2
(45) Date of Patent: Mar. 31, 2020

(54) METHOD FOR CONTROLLING A HEATING UNIT AS WELL AS A HEATING UNIT AND A COMPUTER PROGRAM PRODUCT FOR CARRYING OUT THE CONTROL METHOD

(71) Applicant: Viessmann Werke GmbH & Co. KG, Allendorf (DE)

(72) Inventors: Sebastian Hack, Wetter (DE); Arno Clemens, Allendorf (DE); Martin Ries, Frankenberg (DE)

(73) Assignee: Viessmann Werke GmbH & Co. KG, Allendorf (DE)

( * ) Notice: Subject to any disclaimer, the term of this patent is extended or adjusted under 35 U.S.C. 154(b) by 29 days.

(21) Appl. No.: 15/775,386

(22) PCT Filed: Nov. 11, 2016

(86) PCT No.: PCT/EP2016/077512
§ 371 (c)(1),
(2) Date: May 10, 2018

(87) PCT Pub. No.: WO2017/081307
PCT Pub. Date: May 18, 2017

(65) Prior Publication Data

US 2018/0372317 A1 Dec. 27, 2018

(30) Foreign Application Priority Data

Nov. 11, 2015 (DE) ..... 10 2015 222 155

(51) Int. Cl.
*F23N 1/02* (2006.01)
*F23N 5/12* (2006.01)

(52) U.S. Cl.
CPC ..... *F23N 5/126* (2013.01); *F23N 1/025* (2013.01); *F23N 5/12* (2013.01); *F23N 2223/06* (2020.01);
(Continued)

(58) Field of Classification Search
USPC ..... 431/255
See application file for complete search history.

(56) References Cited

U.S. PATENT DOCUMENTS 8,773,137 B2 * 7/2014 Bertelli ..... F23N 5/123 324/459
2003/0049574 A1 * 3/2003 Dane ..... F23N 5/10 431/76

(Continued)

FOREIGN PATENT DOCUMENTS

DE 19539568 C1 6/1997
DE 20112299 U1 10/2001

(Continued)

OTHER PUBLICATIONS

Office Action dated Aug. 12, 2016 for corresponding DE App. Ser. No. 10 2015 222 155.5 with partial translation attached.

(Continued)

*Primary Examiner* — Avinash A Savani
(74) *Attorney, Agent, or Firm* — Henricks Slavin LLP

(57) ABSTRACT

The present invention relates to a method for controlling a heating unit comprising a burner (1) with a burner housing (2), an ionization electrode (7) associated with the burner (1), and a voltage supply (8) for applying an alternating voltage between the ionization electrode (7) and the burner housing (2), said method comprising the method steps: applying an alternating voltage between the ionization electrode (7) and the burner housing (2) by means of the voltage supply (8) and correcting the output of the voltage supply (8) in the event of parasitic leakage flows. The object of the present invention is in particular to improve the reliability when ascertaining the air-fuel ratio via the ionization current.

10 Claims, 4 Drawing Sheets

Figure 1C:
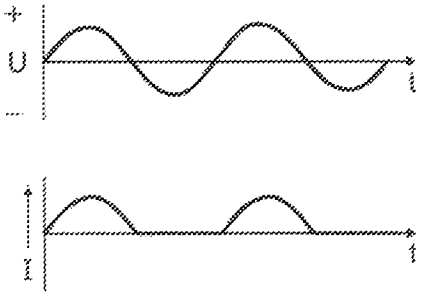

(52) U.S. Cl.
CPC ..... *F23N 2223/42* (2020.01); *F23N 2223/54* (2020.01); *F23N 2229/12* (2020.01)

(56) References Cited

U.S. PATENT DOCUMENTS

| | | | | |
|---|---|---|---|---|
| 2006/0066106 | A1* | 3/2006 | Yang | F23C 13/00 290/1 A |
| 2011/0018544 | A1 | 1/2011 | Bertelli | |
| 2011/0248690 | A1* | 10/2011 | Mimick | F23N 5/102 323/266 |
| 2016/0257801 | A1 | 9/2016 | Wiklund | |

FOREIGN PATENT DOCUMENTS

| | | | |
|---|---|---|---|
| DE | 102005024763 | B3 | 6/2006 |
| DE | 102005009274 | B3 | 7/2006 |
| EP | 1983264 | A2 | 10/2008 |
| EP | 2357410 | A2 | 8/2011 |
| EP | 2495496 | A1 | 9/2012 |

OTHER PUBLICATIONS

International Search Report dated Mar. 2, 2017 for PCT App. Ser. No. PCT/EP2016/077512.

* cited by examiner

METHOD FOR CONTROLLING A HEATING UNIT AS WELL AS A HEATING UNIT AND A COMPUTER PROGRAM PRODUCT FOR CARRYING OUT THE CONTROL METHOD

The present invention relates to a method for controlling a heating unit.

The prior art discloses heating units which are operated by means of gas or by means of oil and have an appropriate gas or oil burner. Such heating units are used for heating buildings, for example.

In order to monitor the burner flame, e.g. a so-called ionization safety device is used in addition to alternative known options, an alternating voltage being applied to said ionization safety device between an ionization electrode and a conductive part of the housing.

As long as the burner burns a burner flame, in which a fuel-air mixture is burned, inter alia a direct current flows via the plasma between the ionization electrode and the conductive part of the burner housing.

A relevant parameter in the operation of such a heating unit is inter alia the air-fuel ratio, the so-called air ratio or the lambda value λ. This value can be adjusted to a desired value, e.g. by varying a blower speed or regulating a fuel valve.

Preferred values for the air ratio λ here range from 1.15 to 1.3. The higher the lambda value λ, the higher the air excess.

The air ratio is monitored e.g. in a method as known from DE 44 33 425 A1 in such a way that an alternating voltage is applied between the ionization electrode and the conductive part of the housing, and a current, which flows off the ionization electrode and is rectified due to the rectifying property of the flame, is detected as the ionization current.

Then, the measured ionization current is compared by means of a control circuit with a set point for the ionization current that corresponds to the adjusted set point of the air ratio, and the composition of the air-fuel mixture is corrected appropriately.

In particular, the inventors of the present invention found that in the high load range of the corresponding heating unit problems occur when determining the air ratio, and the measured ionization current only renders possible an inaccurate or an unreliable determination of the lambda value λ.

Proceeding from the above described problem, an object of the present invention is in particular to improve the reliability regarding the determination of the air-fuel ratio via the ionization current.

In order to solve the above described problem, the present invention proposes a method comprising the features of claim 1.

This method for controlling a heating unit contains at least the method steps: applying an alternating voltage between an ionization electrode and a burner housing by means of a voltage supply and correcting the output of the voltage supply in the event of parasitic leakage currents.

The heating unit contains at least one burner with a burner housing, an ionization electrode associated with the burner and a voltage supply for applying an alternating voltage between the ionization electrode and the burner housing.

It was observed that the above described rectifying effect of the gas flame is merely an idealized model which only shows part of reality.

The inventors of the present invention observed that the resistance in the heating unit, in particular between the ionization electrode and the burner housing, is surprisingly complex and not only of ohmic nature. The resistance has an ohmic and also a capacitive portion. It was found that the burner flame has a capacitor effect in addition to the ohmic portion.

Therefore, the resistance to be observed in the equivalent circuit diagram of the burner flame, which compensates for the correction of the ionization voltage, is complex.

In particular within high load ranges, an oscillating circuit is formed in the burner flame between the ohmic portion and the capacitive portion, which reduces the ionization voltage in relation to the idealized image or lets the ionization voltage collapse.

The above described problem is reduced or eliminated by controlling the correction of the output of the voltage supply in accordance with the invention in the event of parasitic leakage currents.

Therefore, the ionization current flowing between the ionization electrode and the burner housing through the flame at a certain applied alternating voltage is actually lower in reality than in the idealized image when no parasitic leakage currents flow. Correspondingly, e.g. even if the actual air ratio remains constant, the ionization current measured at the ionization electrode, i.e. the proportionality factor between actual air ratio and the measured ionization current can change. In particular, problems occur in the high load range of the corresponding heating unit when the air ratio is determined because the measured ionization current only allows an unreliable determination of the lambda value λ in this very range.

From a conceptual point of view, a distinction is made between an applied alternating voltage and a voltage actually applied to the ionization electrode. The applied alternating voltage here corresponds to the value which is adjusted at or emitted from the voltage supply. However, the voltage actually applied to the ionization electrode is an individual value which does not automatically correspond to the value that is set at the voltage supply.

As a result of the complex resistance, the applied voltage drops or collapses. Therefore, the ionization current-lambda characteristics is no longer usable for controlling the air ratio. The voltage actually applied at the ionization electrode can be adjusted to a predetermined value by correcting the output of the voltage supply.

The amount of such parasitic leakage currents can depend e.g. on the respective load point, at which the heating unit is operated, and/or on the operating period and/or the ambient conditions.

If, as proposed by the present invention, the output of the voltage supply is corrected in the event of such parasitic leakage currents, it is possible that the measured ionization electrode current through the flame can be used for reliably determining the air ratio, in particular also at high load points (up to the full-load operation of the heating unit).

It is not absolutely necessary to already carry out such a correction in the case of minimum leakage currents or immediately when such leakage currents occur but rather at least within an operation range within which leakage currents occur. Nevertheless, it is advantageous to already carry out such a correction in the case of minimum leakage currents or immediately when such leakage currents occur.

Such leakage currents can occur throughout the load range of the heating unit depending on the particular specific heating unit. The output of the voltage supply is preferably raised within these ranges, in particular substantially exclusively within these ranges.

According to an advantageous development defined in claim 2, the output of the voltage supply can be increased with increasing load points of the heating unit.

In particular, it was observed that in the case of high load points, in particular within the upper load range of the heating of preferably above 30%, in particular above 60%, most preferably above 80%, high parasitic leakage currents occur, which cause a voltage drop, as a result of which the ionization current flowing through the flame is lower than in the above described idealized model in which the ionization current is dependent on the air ratio. Therefore, the output of the voltage supply is increased with increasing load points of the heating unit.

As a result, the dependency of the lambda value on the ionization current is no longer clear and various air ratios are represented by the same ionization currents.

Therefore, the output of the voltage supply is increased with increasing load points to compensate for the occurring parasitic leakage currents or the parasitic resistances.

The load points of the heating unit are usually indicated in % between 0 and 100, a load point of 100% representing a full-load operation of the heating unit.

According to an advantageous development of the invention defined in claim 3, it is possible to measure the voltage actually applied to the ionization electrode and to compare it with a set point and, if necessary, to adjust it to this set point.

In order to correct the voltage supply, the voltage actually applied between the ionization electrode and the burner housing is measured in the event of a substantially, at least short-term, constant applied voltage. As soon as this voltage actually applied to the ionization electrode is lowered or increased for a short time, it is assumed that the heating unit is in an operating state, in particular at a load point where leakage currents occur.

By means of the correction of the output of the voltage supply, the supplied voltage (the applied voltage) is changed in such a way that the voltage actually applied to the ionization electrode again corresponds to the set point which is applied to the ionization electrode and which was originally applied.

The output of the voltage supply is preferably upregulated with increasing load points in order that the voltage actually applied between the ionization electrode and the burner housing corresponds to the set point even if parasitic leakage currents occur in this operating state of the heating unit.

According to an advantageous development of the invention defined in claim 4, the correction of the output of the voltage supply can be carried out in such a way that the ionization current detected with respect to each load point can clearly be associated with an air ratio within which the burner is operated.

In the case of an unregulated voltage supply and thus a predetermined applied voltage which is supplied by the voltage supply, a clear assignment of the corresponding ionization current flowing through the flame to the corresponding air ratio value is not possible due to leakage currents in the burner since on account of the additional leakage current the ionization current flowing through the flame is actually lower than expected for the corresponding air ratio.

In order to be able to achieve the corresponding characteristic dependency between air ratio and ionization current, as would be possible without leakage currents, the applied alternating voltage is thus regulated according to the invention in such a way that in each operating state of the burner, in particular with respect to each load point, the very voltage loss occurring as a result of the leakage current at the ionization electrode is substantially compensated for accurately by a voltage change, such that the actual current flowing through the flame corresponds to the current which would flow through this flame without a leakage current.

According to an advantageous development of the invention defined in claim 5, the alternating voltage actually applied to the ionization electrode can be kept substantially constant throughout the load range.

For this purpose, it is advantageous to measure the actual alternating voltage applied to the ionization electrode and keep it constant throughout the load range, from partial load to full load. Even if thus e.g. in the case of higher load a higher leakage current occurs, a higher voltage must correspondingly be adjusted in each case at the voltage supply in order to compensate for the effect of the leakage current. However, the actual voltage should be kept constant at the ionization electrode.

As a result of this constant actual voltage at the ionization electrode, the actual ionization current dependency of the lambda value of the ionization current corresponds to the idealized model and can thus be assigned in a better way.

Different heating units are usually operated, e.g. due to the design, manufacturer or operation, at predetermined alternating voltages applied between the ionization electrode and the burner housing. In particular, these different heating units are each designed for a certain maximum voltage, at which the heating unit can be operated without the risk of being damaged. Such maximum voltage values are preferably chosen to be between 20 and 200 V, in particular between 90 and 150 V, most preferably 130 V+/−10 V. The above mentioned values can each define an upper or lower limit. This means that the heating units are operated at such a voltage. The alternating voltages between the ionization electrode and the burner housing are preferably between 30 and 150 Hz, in particular between 40 Hz and 100 Hz, most preferably 50 Hz+/−10 Hz.

According to an advantageous development of the invention defined in claim 6, the output of the voltage supply can be lowered with increasing load point.

This advantageous development is an alternative to the procedure described in claim 2 or to the above described procedure where the voltage is increased with increasing load point.

The actual behavior of the leakage currents in the various load ranges is burner-specific and depends on the burner geometry, for example.

According to an advantageous development defined in claim 7, a corresponding ionization current/lambda value set point curve can be known for each applied voltage and the applied alternating voltages of the air ratio can be determined by means of the known ionization current/lambda value set point curve.

As described above, there is, in the case of a constant alternating voltage actually applied between the ionization electrode and the burner housing, a well-defined dependency between the respective ionization current and the respective lambda value in the idealized model in so far as no leakage currents occur. In particular, the change in the ionization current is inverse to the change in the air ratio.

If the corresponding dependency between the measured ionization current and the lambda value is known for each applied voltage value, the corresponding lambda value can be determined in each case even in the event of modified actual voltages applied to the ionization electrodes and the burner housing.

According to a coordinated aspect of the invention defined in claim 8, this invention proposes a heating unit with a burner having a burner housing and an ionization electrode associated with a burner housing and a voltage supply for applying an alternating voltage between the ionization electrode and the burner housing.

This heating unit additionally has a control unit which corrects the voltage supply in the event of parasitic leakage currents.

This control unit is preferably designed in such a way that it controls the above mentioned preferred development of the method according to the invention.

Further advantageous developments of the heating unit according to the invention are described in claims 9 and 10.

In addition, the control unit can be designed in such a way that it carries out the above described method steps.

In particular, e.g. a measuring device is provided which measures the voltage actually applied to the ionization electrode and relays the measured values in the control unit, wherein the control unit controls a voltage source as explained above for the described method.

According to an advantageous development defined in claim 11, the burner can have a cylindrical surface which is provided with a perforation structure. The gas-air mixture thus flows over a cylindrical surface and through the perforation structure.

The perforation structure is selected appropriately in the area of the ionization electrode to achieve the largest possible consistency of the described assignment.

The combination of the output control of the voltage supply with the perforation structure ensures an even better assignment between ionization current and lambda value.

According to a further coordinated aspect of the invention, a computer program product is proposed which has computer-executable instructions for carrying out the method according to the invention.

This computer program product can be deposited in the heating unit e.g. in the form of a software within a control or feedback control electronics.

In particular every commercial heating unit can be upgraded by means of the computer program product by installing the software in so far as the heating device has provisions in place according to the device or the design.

Figure 1A:
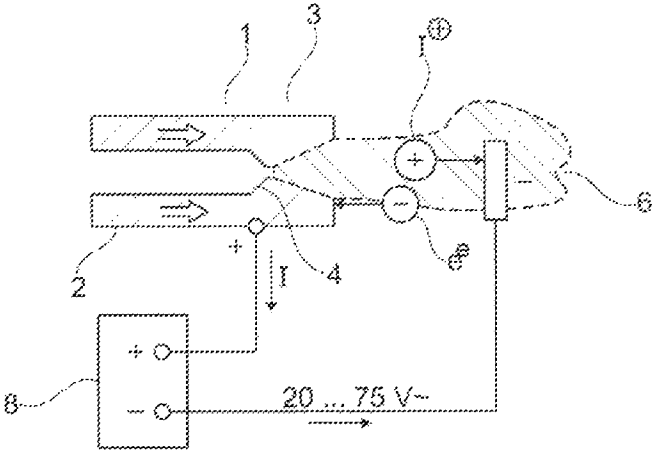
Figure 1B:
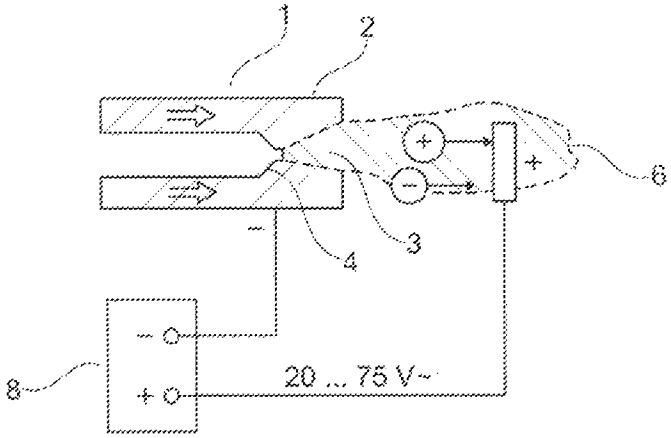
Figure 2:
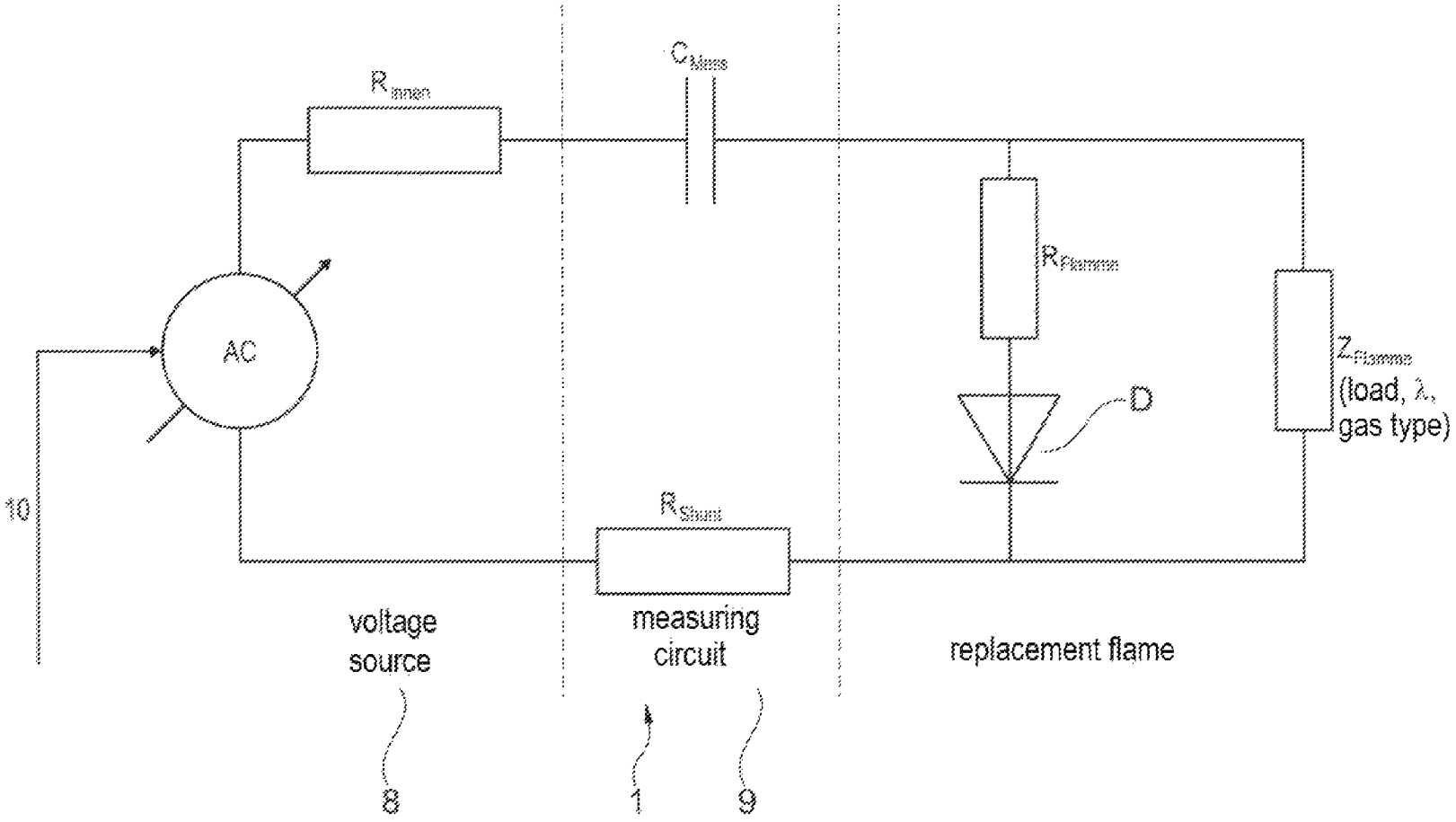
Figure 3A:
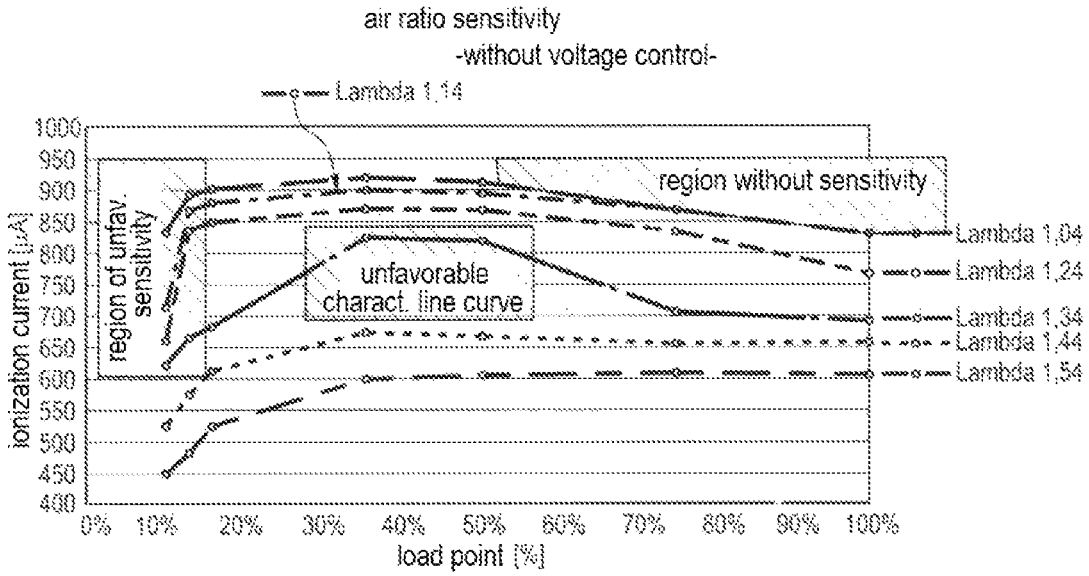
Figure 3B:
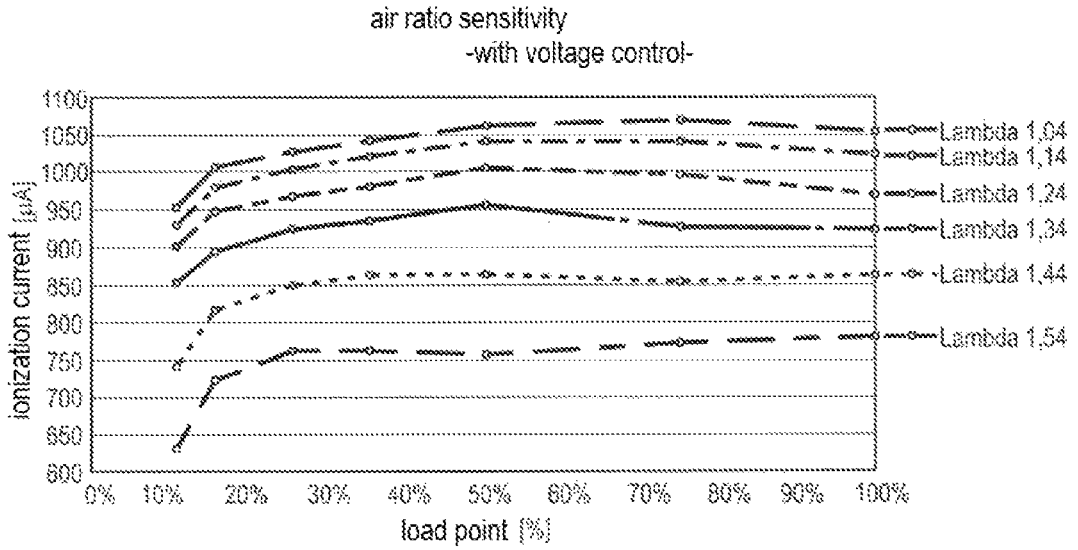
Figure 4:
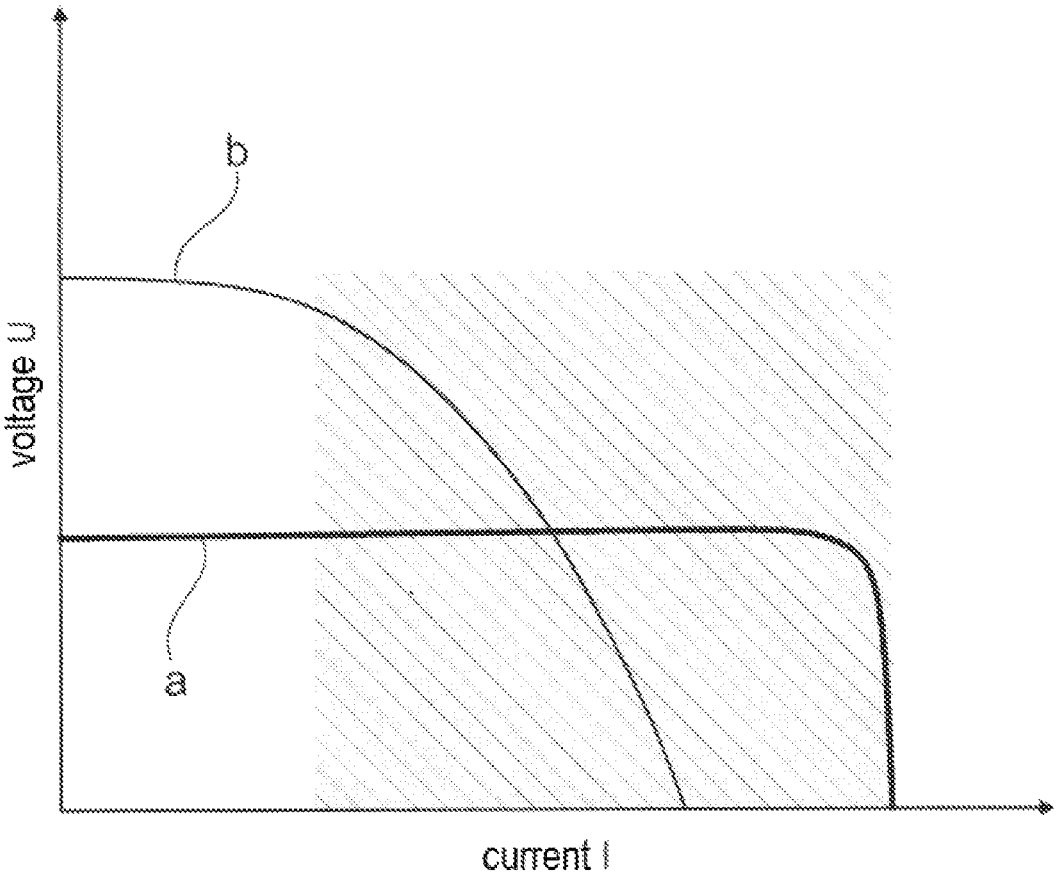

Advantageous developments of the invention are explained in more detail by means of a below explained embodiment in conjunction with the drawing, wherein:

FIG. 1*a* shows a schematic view of a gas burner, wherein the gas burner housing is switched to positive potential and an ionization electrode is switched to negative potential, FIG. 1*b* shows a schematic view of the same burner with reversed polarity, FIG. 1*c* shows the voltage curve over time and the idealized ionization current between burner and ionization electrode in the flame, FIG. 2 shows an equivalent circuit diagram of a burner of a heating device with an alternating voltage supply, FIG. 3*a* shows an ionization current dependency on the load point of the prior art heating device as well as FIG. 3*b* shows an ionization current dependency on the heat load point with a feedback control according to the invention, FIG. 4 shows a voltage characteristic curve without the feedback control according to the invention as well as a voltage characteristic curve in the feedback control according to the invention.

FIG. 1*a* shows, by way of diagram, a burner 1, which is part of a heating unit (not shown).

The burner 1 has a cylindrical burner housing 2 having a front-side opening 3. A gas nozzle 4 is arranged inside the burner housing 2 and concentrically thereto and slightly set back in relation to the front-side opening 3. Air flows into the burner housing 2 and gas flows into the gas nozzle 4 from a rear side of the burner housing 2. The gas from the nozzle 4 is mixed with the air in a mixing zone 5, arranged in front of the nozzle and inside the burner housing.

The gas-air mixture is ignited by means of an igniter (not shown), and a flame 6 is produced, which extends from the housing through the front-side opening 3. An ionization electrode 7 arranged on the front side in front of the opening 3 is provided within the flame.

An alternating voltage is applied between the ionization electrode 7 and the burner housing 2 (cf. FIG. 1*c*). The applied alternating voltage is between 20 and 75 volt; further preferred values are between 20 and 150 V, in particular between 30 and 100 V, most preferably 130 V.

In a variant which is not shown in FIG. 1, the burner 4 has a cylindrical surface which is provided with a perforation structure. Therefore, the gas-air mixture flows over the cylindrical surface and through the perforation structure.

A flame area is thus formed on the surface and is stabilized in particular by the perforation structure. A more constant profile of the ionization current set points is achieved for a constant air ratio by an appropriate selection of the perforation structure. This is advantageous for the feedback control process and also aspects, such as air ratio constancy, in the case of modulation.

A frequency is preferably 50 Hz, further preferred regions are between 30 and 150 Hz, in particular between 40 Hz and 100 Hz, most preferably 50 Hz+/−10 Hz.

The alternating voltage is generated by a voltage supply 8 and is appropriately applied between the ionization electrode 7 and the burner housing 2. The applied alternating voltage is preferably between 20 and 200 V, in particular between 90 and 150 V, most preferably 130 V+/−10 V. The output of the voltage supply can be regulated.

The voltage supply 8 is preferably accommodated in a control unit of the heating unit, which is not shown. This control unit can contain a control unit by means of which the method according to the invention is carried out.

As shown in succession in FIGS. 1*a* and 1*b*, a current flows when the plus pole of the voltage supply 8 is coupled to the burner housing 2 and the minus pole of the voltage supply 8 is coupled to the ionization electrode 7, and in the reverse case, as shown in FIG. 1*b*, no current flows when the burner housing 2 is switched to a negative potential and the ionization electrode is switched to a positive potential since the electrodes $e^-$ in the flame flow with the ions $I^+$ to the ionization electrode 7 where the ions $I^+$ are discharged, i.e. neutralized.

This schematic diagram shows the idealized behavior of the rectification.

The ionization electrode 7 and the burner 2 can have any geometry but these two devices have to be arranged in relation to one another in such a way that an ionization current is produced between the ionization electrode 7 and the burner as a result of the rectifying effect of the flame 6.

Alternatively to the gas burner, it is e.g. also possible to use an oil burner or a burner for another fuel.

FIG. 1*c* correspondingly shows the idealized current flow as compared to the applied voltage over time. As is clear from this figure, the flame 6 has a rectifying effect.

It has surprisingly been shown that in real heating units the resistance in the heating unit, in particular between the ionization electrode and the burner housing, is complex and not only of ohmic nature. This leads to parasitic resistances which in addition to the ionization current through the burner flame are responsible for another parasitic current flow.

A corresponding equivalent circuit diagram of a real burner 1 is shown e.g. in FIG. 2, this burner also having a measuring circuit 9, by means of which, as described below, the voltage actual applied between the ionization electrode 7 and the burner housing 2 is measured and the voltage supply 8 is correspondingly readjusted on this basis.

The voltage supply 8 is shown by way of diagram on the left-hand side of FIG. 2 and has a resistance $R_{innen}$.

An equivalent circuit diagram of the burner 6 is shown on the right-hand side of FIG. 2. The idealized flame 6 itself, which includes the rectifying effect, is formed by the diode D and by the flame resistance $R_{Flamme}$. Said figure shows a parasitic resistance $Z_{Flamme}$, which is connected in parallel thereto and is responsible for a parasitic current flow on the basis of the operating parameters, such as load, lambda value and type of gas.

The parasitic resistance $Z_{Flamme}$ is complex and therefore, as a sort of impedance, it is also labeled with the common reference sign Z as used in connection with coils. The resistance has an ohmic portion and also a capacitive portion. It was found that the burner flame has the ohmic portion and also a capacitor effect.

An oscillating circuit between the ohmic portion and the capacitive portion is formed in the burner flame, in particular within high load ranges, which reduces the ionization voltage compared to the idealized image or causes the ionization voltage to collapse.

The arrow in FIG. 2 labeled with the reference sign 10 shows by way of diagram that the voltage supply 8 in the method according to the invention is controlled by means of the actually measured voltage of the ionization electrode 7.

FIG. 3*a* shows an ionization current dependency on the load point for different lambda values without the control according to the invention, i.e. without the output stabilization, and FIG. 3*b* shows an ionization current dependency on the load point for different lambda values with the control according to the invention, i.e. with the output stabilization.

Starting at the top, the lines in FIGS. 3*a* and 3*b* correspond to the lambda values of 1.04, 1.14, 1.24, 1.34, 1.54, which are shown on the right-hand sides in the corresponding figures, i.e. the air excess increases in the graphs from top to bottom.

As can be seen e.g. in FIG. 3*a* at a low load point of 10%, the measured ionization current is increased with increasing lambda substantially inversely thereto (vertical section at 10% load point). The change in the ionization current is inversely proportional to the change in the air ratio.

The values plotted on the Y-axis are current values (amperage in μA). The lower the corresponding lambda value, the higher the respectively measured ionization current.

The measured ionization current shall be described below with a predetermined preadjusted voltage at the voltage supply 8 for the lambda value of 1.34 ($4^{th}$ line from the top in FIG. 3*a*).

When the load point is increased from about 10% to about 40%, the measured ionization current will increase.

In a further increase in the load point, however, the ionization current first plunges between about 50% and about 75%. This drop of the measured ionization current between ionization electrode 7 and burner housing 2 is due to the fact that a parasitic current flow occurs. As a result, the voltage actually applied between the ionization electrode 7 and burner 1 drops and the ionization current in the flame is lowered correspondingly.

As shown in FIG. 3*a*, the two curves for the lambda value of 1.14 and 1.04 intersect at the 75% load point (cf. the upper two lines in FIG. 3*a*; $2^{nd}$ point from the right on the respective graphs in FIG. 3): Although the lambda values are different, the same ionization current is measured.

Therefore, it is no longer possible to draw conclusions from the ionization current about the corresponding air ratio and/or the lambda value.

The hatched area (region without sensitivity) of 50% to 100% and between the lines for an air ratio of 1.04 and 1.14, which is shown in FIG. 3*a*, therefore does not show any air ratio sensitivity.

This means that the ionization current cannot be used in this load range for determining the air ratio. Such load ranges can be as follows: above 30%, preferably above 50%, in particular above 70% but below 100%. The described values can each be an upper limit and lower limit.

FIG. 3*a* shows three different ranges. Up to a load point of 10%, the current surges (at least for lambda values of 1.34 and more). This range is referred to as a range of unfavorable sensitivity because a measurement within this range can contain considerable defects. In addition to this range and the above described range without sensitivity, in particular the characteristic line for lambda 1.34 has an unfavorable characteristic curve within the range of the peak.

However, FIG. 3*b* shows the same dependency for the corresponding seven lambda values with the control according to the invention. In so far as the actual voltage measured on the ionization electrode 7 is measured and this voltage is e.g. kept constant in accordance with the load point, the lines of the ionization current dependency on the load point no longer intersect for the corresponding lambda values.

For example, as soon as there is a parasitic resistance or leakage current, the output of the voltage supply 8 is upregulated.

In this way, it is also possible to clearly determine the air ratio for low lambda values of below 1.14 since the corresponding lines in FIG. 3*b* do not intersect. The corresponding graphs for the individual lambda values in FIG. 3*b* all slightly increase. Only the graph for the lambda value of 1.3 slightly drops between about 50% and 70% of the load point. Nevertheless, there is no intersection or contact between the individual graphs.

In particular, this is due to the fact that the corresponding voltage value actually applied to the ionization electrode 7 is adjusted.

FIG. 4 shows a comparison of a dependency of the applied voltage (voltage adjusted at the voltage supply) on the ionization current. At the line referred to as a, the applied voltage is always constant even if the ionization current is lowered due to the leakage currents with equal load point. In the method according to the invention (cf. line b in FIG. 4), the voltage supplied by the voltage source is increased in the case of an ionization current lowered on account of occurring leakage currents. As a result, a constant actual voltage is applied between the ionization electrode 7 and the burner.

LIST OF REFERENCE SIGNS

1 burner
2 burner housing
3 opening
4 gas nozzle
5 mixing zone
6 flame
7 ionization electrode
8 voltage supply
9 measuring circuit
10 control D diode $R_{Flamme}$ resistance $Z_{Flamme}$ leakage resistance

The invention claimed is:

1. A method for controlling a heating unit comprising a burner (1) with a burner housing (2), an ionization electrode (7) associated with the burner (1), and a voltage supply (8) for applying an alternating voltage between the ionization electrode (7) and the burner housing (2), comprising the steps of:

applying an alternating voltage between the ionization electrode (7) and the burner housing (2) by means of the voltage supply (8), and correcting the output of the voltage supply (8) in the event of parasitic leakage flows, wherein a voltage which is actually applied to the ionization electrode (7) is measured, compared to a set point and, if necessary, is adjusted to the set point.

2. The method according to claim 1, wherein the output of the voltage supply (8) is increased with rising load points of the gas heating unit.

3. The method according to claim 1, wherein the correcting of the output of the voltage supply (8) is carried out in such a way that the detected ionization current for each load point can clearly be assigned to an air ratio at which the burner (1) is operated.

4. The method according to claim 1, wherein the alternating voltage which is actually applied to the ionization electrode (7) is kept substantially constant throughout the load range.

5. The method according to claim 1, wherein the output of the voltage supply (8) is lowered with rising load point.

6. The method according to claim 1, wherein an ionization current set point curve is known for each applied alternating voltage and the air ratio is determined on the basis of the known ionization current set point curve and the applied alternating voltage.

7. A heating unit, comprising:

a burner (1) with a burner housing (2), an ionization electrode (7) associated with the burner (1), a voltage supply (8) for applying an alternating voltage between the ionization electrode (7) and the burner housing (2), and a control unit which corrects a voltage supply (8) in the event of parasitic leakages, the control unit being designed in such a way that it has a measuring unit by means of which the voltage actually applied to the ionization electrode (7) is measured, and the control unit compares the voltage actually applied to the ionization electrode (7) with a set point and, if necessary, adjusts it to the set point.

8. The gas heating unit according to claim 7, wherein the control unit is designed in such a way that the output of the voltage supply (8) is raised or lowered with rising load points of the gas heating unit.

9. The gas heating unit according to claim 7, wherein the burner has a cylindrical surface which is provided with a perforation structure.

10. A computer program product with computer-executable instructions for executing the method according to claim 1.

* * * * *